US011767845B2

(12) United States Patent
Kraft et al.

(10) Patent No.: US 11,767,845 B2
(45) Date of Patent: Sep. 26, 2023

(54) OIL-LUBRICATED ROTARY VANE VACUUM PUMP

(71) Applicant: Gebr. Becker GmbH, Wuppertal (DE)

(72) Inventors: Artjom Kraft, Bochum (DE); Ulli Kriebel, Solingen (DE); Bernhard Radermacher, Korschenbroich (DE); Carsten Bender, Bottrop (DE); Carsten Posser, Oberhausen (DE)

(73) Assignee: Gebr. Becker GmbH, Wuppertal (DE)

( * ) Notice: Subject to any disclaimer, the term of this patent is extended or adjusted under 35 U.S.C. 154(b) by 260 days.

(21) Appl. No.: 17/428,733

(22) PCT Filed: Mar. 4, 2020

(86) PCT No.: PCT/EP2020/055704

§ 371 (c)(1),
(2) Date: Aug. 5, 2021

(87) PCT Pub. No.: WO2020/178344

PCT Pub. Date: Sep. 10, 2020

(65) Prior Publication Data

US 2022/0099093 A1 Mar. 31, 2022

(30) Foreign Application Priority Data

Mar. 6, 2019 (DE) ..... 10 2019 105 695.0

(51) Int. Cl.
*F04C 18/344* (2006.01)
*F04C 25/02* (2006.01)
(Continued)

(52) U.S. Cl.
CPC ..... *F04C 18/344* (2013.01); *F04C 25/02* (2013.01); *F04C 29/026* (2013.01); *F04C 29/12* (2013.01);
(Continued)

(58) Field of Classification Search
CPC ..... F04C 18/344; F04C 2230/80; F04C 2240/30; F04C 25/02; F04C 29/026; F04C 29/12
See application file for complete search history.

(56) References Cited

U.S. PATENT DOCUMENTS 6,966,938 B2 11/2005 Buergin et al.
7,981,185 B2 7/2011 Bilger
(Continued)

FOREIGN PATENT DOCUMENTS

CN 108661905 A * 10/2018 ..... F04C 25/02
DE 10 2015 107 721 A1 11/2016
(Continued)

OTHER PUBLICATIONS

International Search Report of PCT/EP2020/055704, dated May 15, 2020.

*Primary Examiner* — Anthony Ayala Delgado
(74) *Attorney, Agent, or Firm* — Collard & Roe, P.C.

(57) ABSTRACT

An oil-lubricated rotary vane vacuum pump includes a rotary vane unit, having a rotary vane chamber and a rotary vane rotor, and an oil separator device having an air/oil separating unit that has a filter element with a plug-in ring that can be plug-connected on a housing side. The plug-in ring is designed for radial sealing and axial displaceability in a housing receptacle. The filter element has a moulding for bayonet mounting, which faces the end associated with the outer wall. A mounting wall of the housing, extending at a distance from the outer wall of the housing, is designed to interact with the moulding of the filter element and to form the bayonet mounting. A separate cover closes a mounting opening associated with the filter element in the outer wall of the housing. The cover form-fittingly interacts with the filter element to secure the filter element against rotation.

9 Claims, 11 Drawing Sheets

(51) Int. Cl.
*F04C 29/02* (2006.01)
*F04C 29/12* (2006.01)

(52) U.S. Cl.
CPC ..... *F04C 2230/80* (2013.01); *F04C 2240/30* (2013.01)

(56) References Cited

U.S. PATENT DOCUMENTS

| | | | | |
|---|---|---|---|---|
| 10,697,298 | B2 | 6/2020 | Kraft et al. | |
| 2019/0257310 | A1 | 8/2019 | Kraft et al. | |
| 2020/0222843 | A1 * | 7/2020 | Biebricher ..... | B01D 46/0031 |

FOREIGN PATENT DOCUMENTS

| | | | |
|---|---|---|---|
| EP | 2 117 671 | A1 | 11/2009 |
| EP | 3 298 241 | A1 | 3/2018 |
| WO | 02/068091 | A2 | 9/2002 |
| WO | 2008/064713 | A1 | 6/2008 |
| WO | 2016/184839 | A1 | 11/2016 |
| WO | 2018/007443 | A1 | 1/2018 |

* cited by examiner

OIL-LUBRICATED ROTARY VANE VACUUM PUMP

CROSS REFERENCE TO RELATED APPLICATIONS

This application is the National Stage of PCT/EP2020/055704 filed on Mar. 4, 2020, which claims priority under 35 U.S.C. § 119 of German Application No. 10 2019 105 695.0 filed on Mar. 6, 2019, the disclosure of which is incorporated by reference. The international application under PCT article 21(2) was not published in English.

TECHNICAL FIELD

The invention relates to an oil-lubricated rotary vane vacuum pump comprising a rotary vane unit, having a rotary vane chamber and a rotary vane rotor, and comprising an oil separator device wherein gas and oil are separated in the oil separator device, preferably by an air/oil separating unit, wherein the air/oil separating element has a filter element which has a plug in ring at an end that can be plug connected on a housing side, which plug-in ring is designed for radial sealing and axial displaceability in an assigned housing receptacle, and the filter element has a moulding for bayonet mounting, which moulding faces the end assigned to the outer wall.

PRIOR ART

Rotary vane vacuum pumps are usually a rotary vane blower with a rotary vane housing forming a rotary vane chamber, which rotary vane chamber is formed in the shape of a cylindrical bore. The rotary vane rotor is usually formed cylindrically, with vanes slidably arranged in slots in the rotor. The slots in the rotor can be oriented strictly radially with respect to a cross-section through the rotor or can extend at an acute angle to a radial, According to the prior art, the rotor is preferably supported in the region of the side covers closing off each of the ends of the rotary vane housing.

During operation of the vacuum pump, the rotor rotates radially offset from the center axis of the rotary vane housing. This results in closed chambers, separated by the substantially radially displaceable vanes, the size of which changes during one revolution of the rotor. The change in size results in pressure differences between the individual chambers and thus between the inlet side and the outlet side of the pump.

In oil-lubricated rotary vane vacuum pumps, oil is introduced into the rotary vane housing. This oil causes gaps between the various components to be clogged. Thus, the exchange of gases between the chambers forming between the vanes is also impeded. In this manner, higher vacuums are achieved during operation than with so-called dry-running rotary vane vacuum pumps.

For design-related reasons, the oil is conveyed from the last chamber to the outlet together with the conveyed gas. In addition, due to the compression enthalpy, the oil in the system is heated. The oil can also become contaminated or can change as a result of possible chemical reactions when it comes into contact with the conveyed medium. From this, a preferred treatment of the oil after leaving the blower region can take place. In this regard, it is known to let the oil run through the device in a cycle.

It is further known to perform the oil treatment process substantially in different sub-processes. Thus, in first instance, oil and gas can be separated in several stages, if necessary, for example according to a coarse separation of large oil droplets, furthermore, for example by a gravity and/or impact separation. A further sub-process can be the filtering of the oil in an air/oil separating element comprising a filter element.

Moreover, it is known to accommodate the oil separator device, and where appropriate, also a reprocessing device in combination therewith, in an oil separator housing which is separate from the rotary valve housing but, where appropriate, is coupled thereto.

Such a rotary vane vacuum pump is known, for example, from DE 10 2015 107 721 A1. The air/oil separating element provided here is exchangeably accommodated in an oil separator housing adjacent to the rotary vane housing. In this case, the air/oil separating element is substantially plugged-mounted in the oil separator housing.

Furthermore, from WO 02/068091 A2, an air/oil separating element is known which can be mounted in the oil separator housing in question via a bayonet mounting.

From EP 3 298 241 A1, a rotary vane vacuum pump is known in which an oil separator device is mounted to a rear wall only at its rear end. The rear wall, associated with an outer wall, is arranged extending at a distance from the oil separator device, without a connection to the oil separator device.

A comparable prior art is also known from WO 2018/007443 A1.

From EP 2 117 671 A1 (WO 2008/064713 A1), a device for extracting droplets is known, in which a separator device is provided. However, the separator device is merely plug-connected or slide-mounted in a receptacle using sealing O-rings.

SUMMARY OF THE INVENTION

In view of the prior art set forth, the invention is concerned with the object of further improving a rotary vane vacuum, pump of the type in question in terms of handling and/or maintenance.

This object is achieved by a rotary vane vacuum pump, wherein it is intended that, for interacting with the moulding of the filter element and for forming the bayonet mounting, a mounting wall of the housing extending at a distance from the outer wall of the housing is formed, that a separate cover is provided which permits a mounting opening, associated with the filter element, in the outer wall of the housing to be closed, and that the cover form-fittingly interacts with the filter element to secure the filter element against rotation.

The air/oil separating element or the filter element in question is offset in the assignment position and use position with respect to the substantially outer wall at the end-face of the oil separator device towards the device interior. In this case, the end in question of the filter element, which end is substantially associated with the outer wall, interacts in a bayonet-like manner with an inner mounting wall of the housing. Where appropriate, this mounting wall can be oriented substantially in parallel with the facing outer wall.

The provided mounting opening in the outer wall can serve solely for accessing the filter element provided in the oil separator device, in particular for removing or correspondingly assigning the same. This mounting opening, as is also preferred, can be closeable by a separate cover, more preferably in particular closable by a cover separate from, the filter element. For example, the cover can be arrangeable only after the filter element has been correctly arranged in the oil separator device.

Furthermore, according to the present invention, an operationally correct arrangement of the filter element can in first instance he carried out even without closing the cover of the mounting opening. Thus, the filter element can be brought through the mounting opening into a preferred sealing fit in the region of the end comprising the plug-in ring, due to a bayonet-like interlock.

Furthermore, in the arrangement position of the cover for closing the mounting opening, the cover can also interact with the filter element in a form-fitting manner for securing the filter element against rotation. According to a preferred configuration, the filter element can be secured in the circumferential direction when the cover is attached for closing the mounting opening. Moreover, in the course of attaching the cover for closing the mounting opening, the correct alignment of the filter element in the circumferential direction and thus the correct bayonet latching position can also be checked. For example, if the bayonet latching position of the filter element is not correct, it is not possible to correctly attach the cover for closing the mounting opening.

It can be provided that the cover is designed for plug-in mounting in the housing. Furthermore, for example, a snap-in fixing or the like can also serve for the plug-in mounting.

In this respect it is preferred that the cover can be fixed to the housing by means of screws. Here, the screws can be accessible from the outside, in this case extending through the cover, for interaction with corresponding internal threads, for example in the region of the oil separator housing.

Furthermore, the filter element, associated with the outer wall, can have a handling extension projecting from a flange part of the filter element toward the outer wall of the housing. This handling extension, as is also preferred, can serve for inserting and locking or unlocking and for removing the filter element into or from the housing of the oil separator device. In this case, the handling extension can be grasped through the mounting opening freed from the cover for this purpose.

In a preferred configuration, the handling extension does not protrude outwardly beyond the opening plane of the mounting opening in the operating position of the filter element. Rather, the handling extension ends at a distance from this opening plane which is defined by the outwardly facing circumferential edge of the mounting opening.

The flange part of the filter element, which in one possible configuration carries the handling extension, can be designed for interaction with the mounting wall of the housing, furthermore in particular for bayonet-like interaction.

In a possible configuration, the handling extension can be formed in a knob-like manner, thus, furthermore correspondingly comprising a ball-like encompassing portion, where appropriate.

In a further embodiment, the handling extension can comprise one or more plate parts. In this case, as is also preferred, these can be plate parts made of a hard plastic. In this regard, these plate parts can furthermore be formed integrally and, where appropriate, from one material with the aforementioned flange part of the filter element.

Moreover, the handling extension can consist of two plate parts arranged in a cross-shaped manner. This cross shape, as is also preferred, can arise with respect to a projection along a longitudinal axis of the filter element or along a plug-in direction of the filter element onto a plane oriented transversely to the plug-in direction or longitudinal axis. More preferably, the flange part can also substantially extend in this transversely oriented plane.

Moreover, the handling extension, in particular in interaction with the cover closing the assembly opening, can also form-fittingly interact with the cover in order to thereby secure the filter element against rotation in the operational use position of the filter element.

In a preferred configuration, the gas freed of oil exits substantially radially outwardly via the casing wall of the filter element and is then guided in a chamber substantially accommodating the filter element towards the end of the filter element facing the outer wall. From here, the gas exits to the outside, for which purpose, according to one possible configuration, a through opening can be provided at the cover. Moreover, the cover can also have a plurality of such through openings for discharging purified gas, for example two, three or four such openings.

In another configuration, a through opening, at the cover inside facing the filter element, can comprise a wall extension that substantially lengthens the circumferential wall of the through opening in the cover in the plug-in direction of the cover for closing the mounting opening. According to one possible configuration, such a wall extension can enter into a form-fitting connection with the handling extension of the filter element. Via this form-fitting connection, in the cover mounting position for closing the mounting opening, securing the filter element against rotation in the operational use position can be achieved.

In a possible configuration of the handling extension consisting of two plate parts arranged in a cross-shaped manner, a previously described wall extension of a through opening can extend, for example, between two portions following one another in the circumferential direction and thus engage in a blocking manner with respect to a possible rotational displacement of the filter element about the longitudinal axis of the filter element.

BRIEF DESCRIPTION OF THE DRAWINGS

The invention is described below in more detail with reference to the accompanying drawing, which merely shows an exemplary embodiment. In the figures.

DESCRIPTION OF THE EMBODIMENTS

Figure 1:
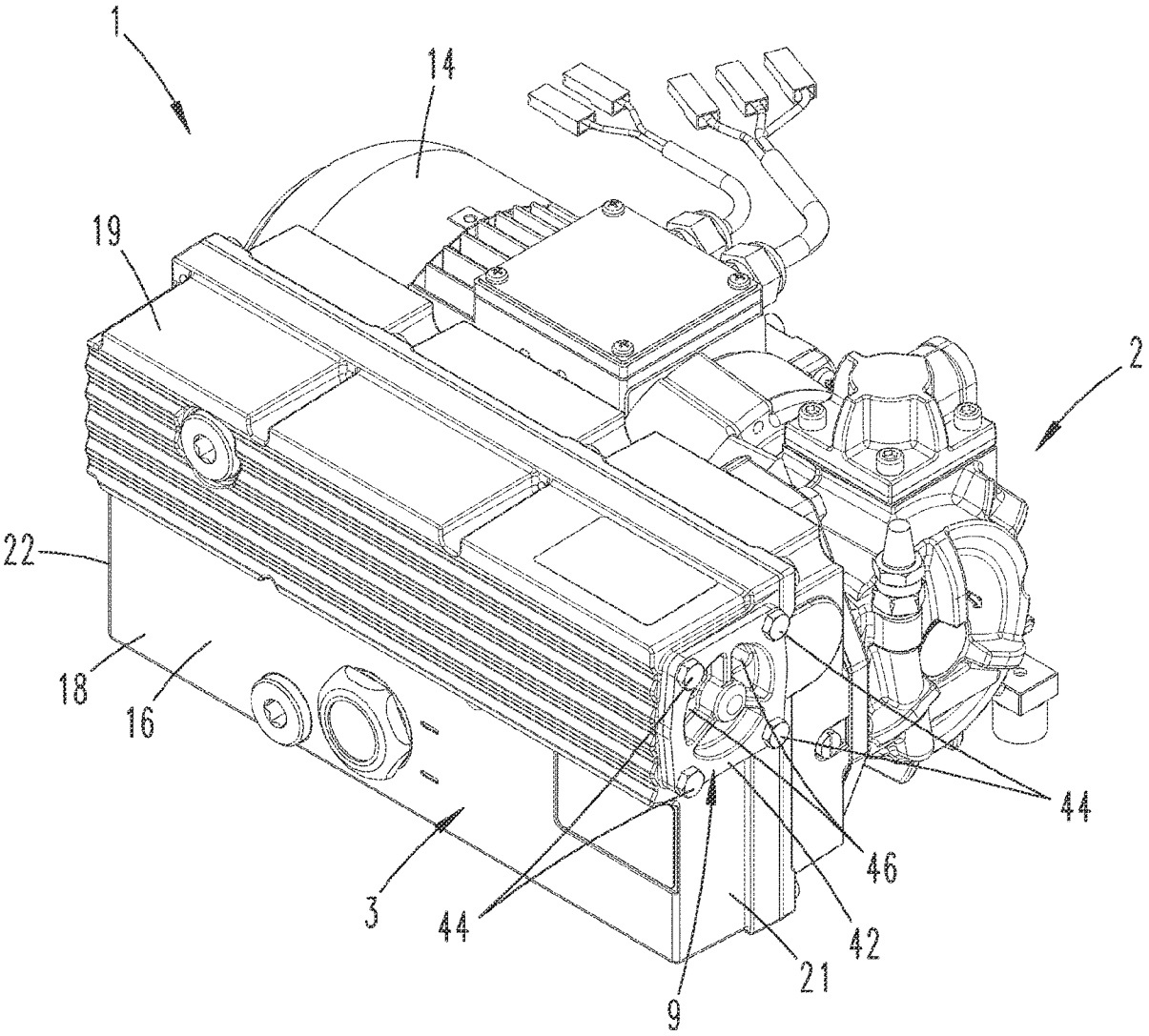
FIG. 1 shows a perspective view of an oil-lubricated rotary vane vacuum pump.
Figure 2:
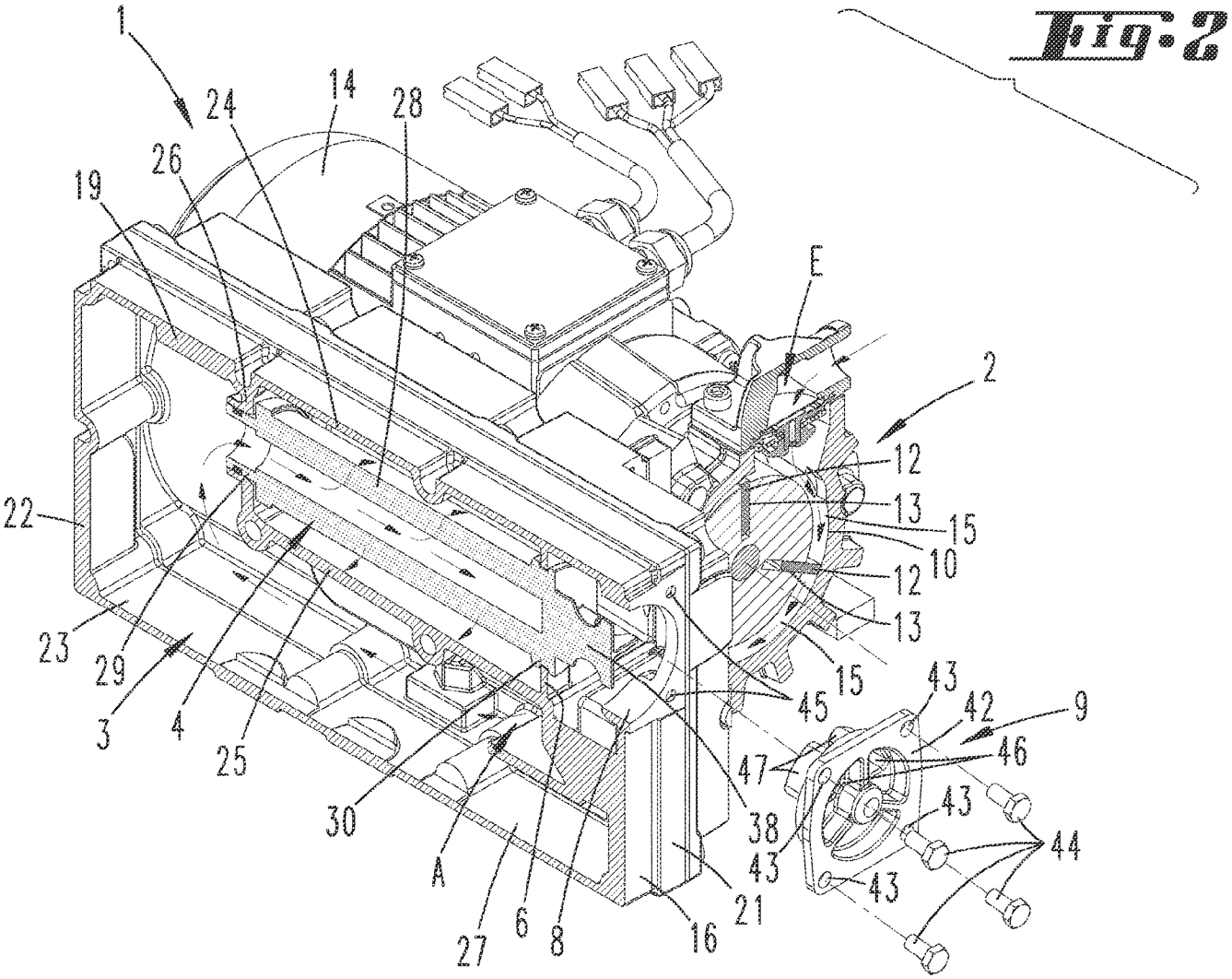
FIG. 2 shows a perspective view according to FIG. 1, but partially sectioned in the region of an oil separator device and a rotary vane chamber, further with a removed cover exposing a mounting opening.

Shown and described, in first instance with reference to FIGS. 1 and 2, is an oil-lubricated rotary vane vacuum pump 1 with a rotary vane unit 2 and an oil separator device 3 in which an air/oil separator element 4 is accommodated. The air/oil separating element 4 is mounted in the region of a mounting wall 6 provided at a distance from an outer wall 21 of the oil separator device 3 by a bayonet mounting 7. In the correct operating state of the rotary vane vacuum pump 1, the mounting opening 8 in the outer wall 21 permitting access to the air/oil separating element 4 is closed by a separate cover 9.

The rotary vane unit 2 can have a unit housing in which a rotary vane chamber 10 with a rotary vane rotor 11 is arranged.

The rotary vane chamber 10 may be formed in the manner of a cylindrical bore in the unit housing. In this case, the rotary vane chamber 10 has a longitudinal extent which can be oriented along the bore axis of the rotary vane chamber 10.

The preferably cylindrical rotary vane rotor 11 is arranged eccentrically with respect to the rotary vane chamber 10. Accordingly, a rotor axis runs parallel but offset to the spatial axis of the rotary vane chamber 10.

Furthermore, the rotary vane rotor 11 can have a plurality of vanes 12, three in the exemplary embodiment. With reference to a cross-section according to the illustration in FIG. 2, these vanes can be arranged so as to be slidably movable in approximately radially aligned slots 13 of the rotary vane rotor 11. Due to the rotation of the rotary vane rotor 11, the vanes 12 are pressed by the resulting centrifugal force against the wall delimiting the rotary vane chamber 10.

During operation of the vacuum pump 1, the rotary vane rotor 11 rotates radially offset with respect to the center axis of the rotary vane chamber 10, namely as a result of being driven by a motor, in particular an electric motor 14, acting rotationally on the rotor shaft. This results in closed chambers 15, separated by the radially displaceable vanes 12, the size of which changes during one rotation of the rotary vane rotor 11.

The change in size of the chambers 15 during operation of the vacuum pump 1 results in pressure differences between the individual chambers 15 and thus between the inlet side E and the outlet side A of the blower formed in this manner. The outlet side A, as is also preferred, can be provided in a passage into the oil separator device 3, which is not shown in detail.

Oil-lubricated rotary vane units 2 are characterized in that in these units, oil is introduced into the rotary vane chamber 10. This oil clogs gaps between the various components, in particular between the vanes 12 and the wall of the rotary vane chamber 10. Thus, the gas exchange between the various chambers 15 is impeded. In this way, higher vacuums are achieved during operation than is possible with dry-running rotary vane vacuum pumps.

For design-related reasons, the oil is conveyed out of the last chamber 15 of the rotary vane unit 2 together with the conveyed gas and enters the oil separator device 3 at the outlet side A as an oil-gas mixture.

The oil runs in a cycle through the vacuum pump 1. In the oil separator device 3, a separation of oil and gas is achieved.

The oil separator device 3 can be connected to the rotary vane unit 2 so that, where appropriate, a unit is formed consisting of rotary vane unit 2, oil separator device 3 and electric motor 14.

The oil separator device 3 which, furthermore, can be supplemented by an oil reprocessing device, preferably has an oil separator housing 16, with side walls 17, 18, a top wall 19, a bottom wall 20 and outer walls 21, 22 at the end faces. In this case, according to the embodiment shown, the outer walls 21, 22 can extend transversely to the rotor axis in the rotary vane unit 2, wherein according to the exemplary embodiment shown, the outer wall 21 can be associated with the side facing away from the electric motor 14.

Figure 3:
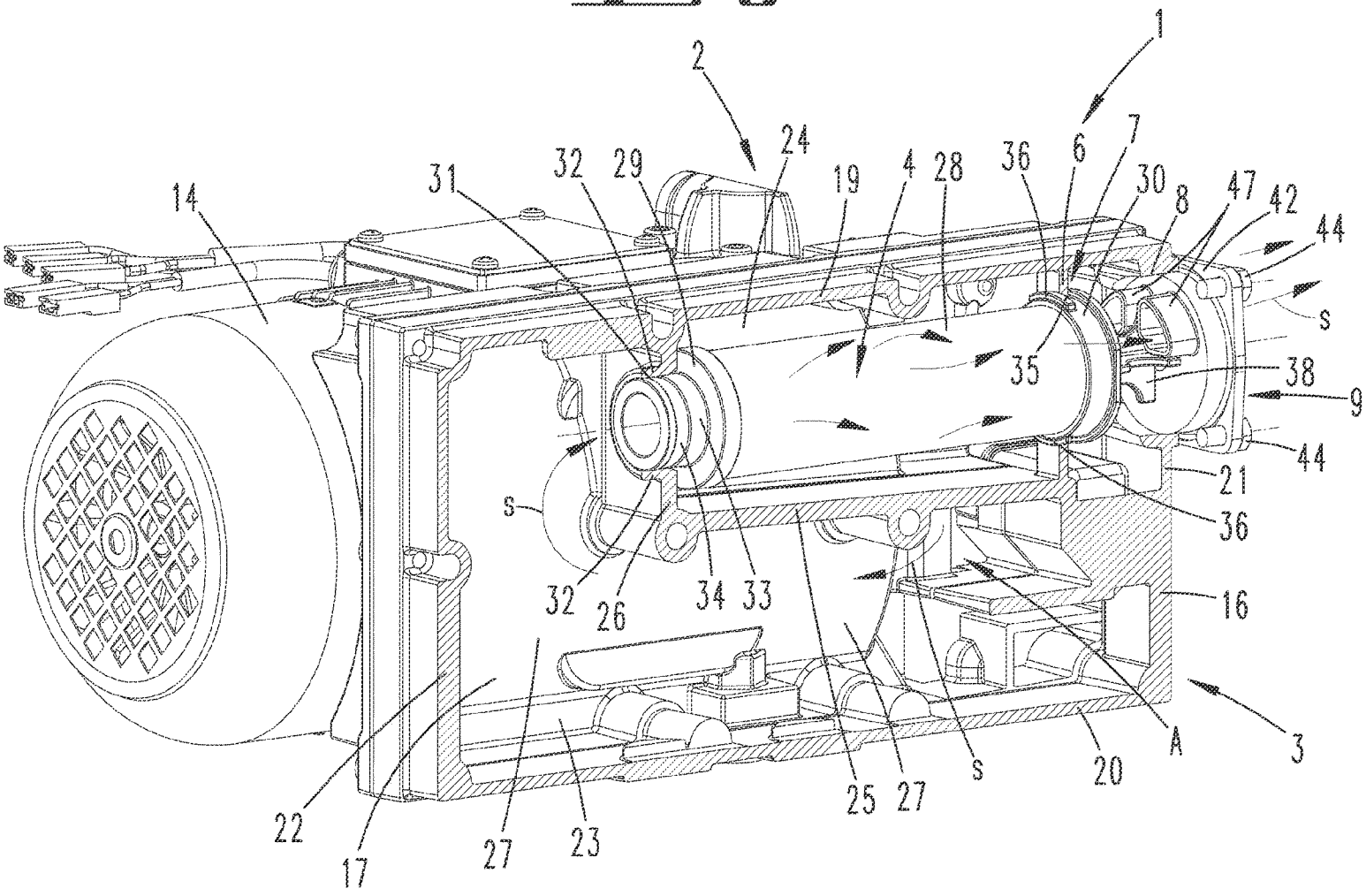
FIG. 3 shows a further partially sectioned perspective view of the pump overlooking the oil separator device.

The oil separator device 3 can have a preferably integrally formed chamber. With respect to a placement state as also shown in the drawings, the result with respect to gravity is a lower chamber 23 and an upper chamber 24. The separation of the chambers 23 and 24 is achieved by a separating bottom 25 which, with respect to a cross-section according to FIG. 3, extends transversely to the side walls 17, 18.

The upper chamber 24 serves substantially to accommodate the air/oil separating element 4, and in this case, as is also preferred, can extend substantially in the same direction as the rotor axis. This can result in a boundary at each end in the longitudinal direction of extent of the upper chamber 24 by mounting walls 6, 26.

During operation of the vacuum pump 1, the oil/gas mixture from the rotary vane unit 2 enters into the oil separator device 3 via a through opening in the region of the side wall 17, which is not shown.

In the process of this, in first instance, a coarse separation of large oil droplets can take place by means of a gravity and/or impact separator.

The housing portion 27 resulting below the outlet side A in the oil separator housing 16 can serve in the manner of an oil pan, in which an oil sump collects. Thus, an oil collecting tank can be formed in the lower chamber 23.

Furthermore, the lower chamber 23 forms a flow path with a flow s oriented along the longitudinal direction of the housing 16. This flow s is substantially directed toward the rear outer wall 22, in which region of the rear outer wall 22 a deflection of the flow s for entering the upper chamber 24 occurs.

The air/oil separating element 4 accommodated in the upper chamber 24 has a filter element 28, in particular in the form of a fine separating device.

Figure 4:
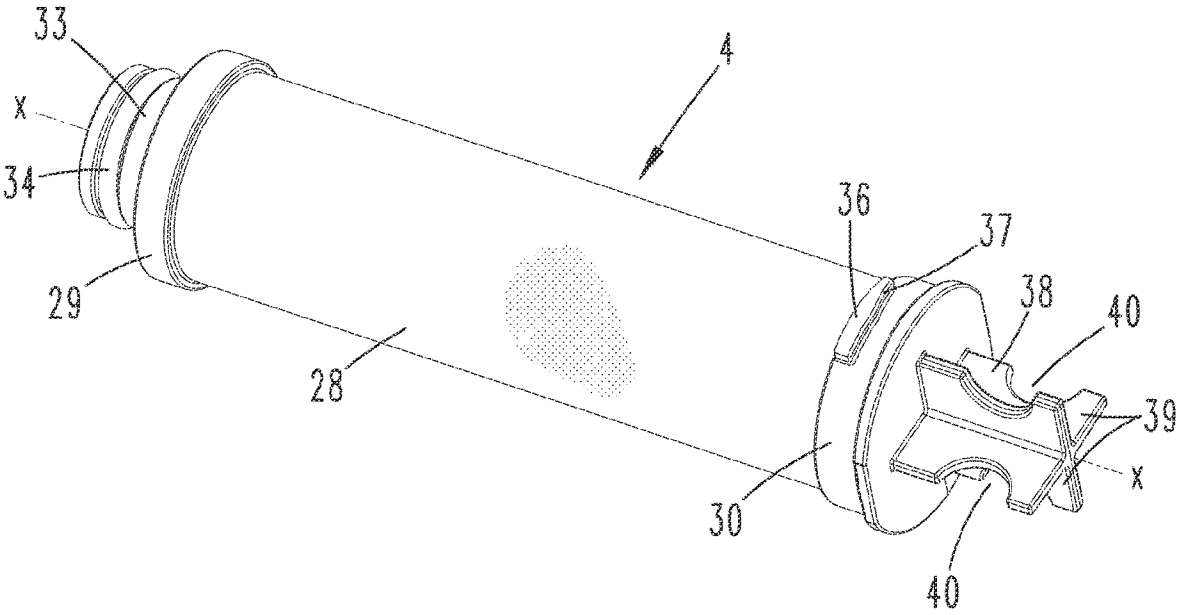
FIG. 4 shows an individual perspective view of an air/oil separating element of the oil separator device.
Figure 5:
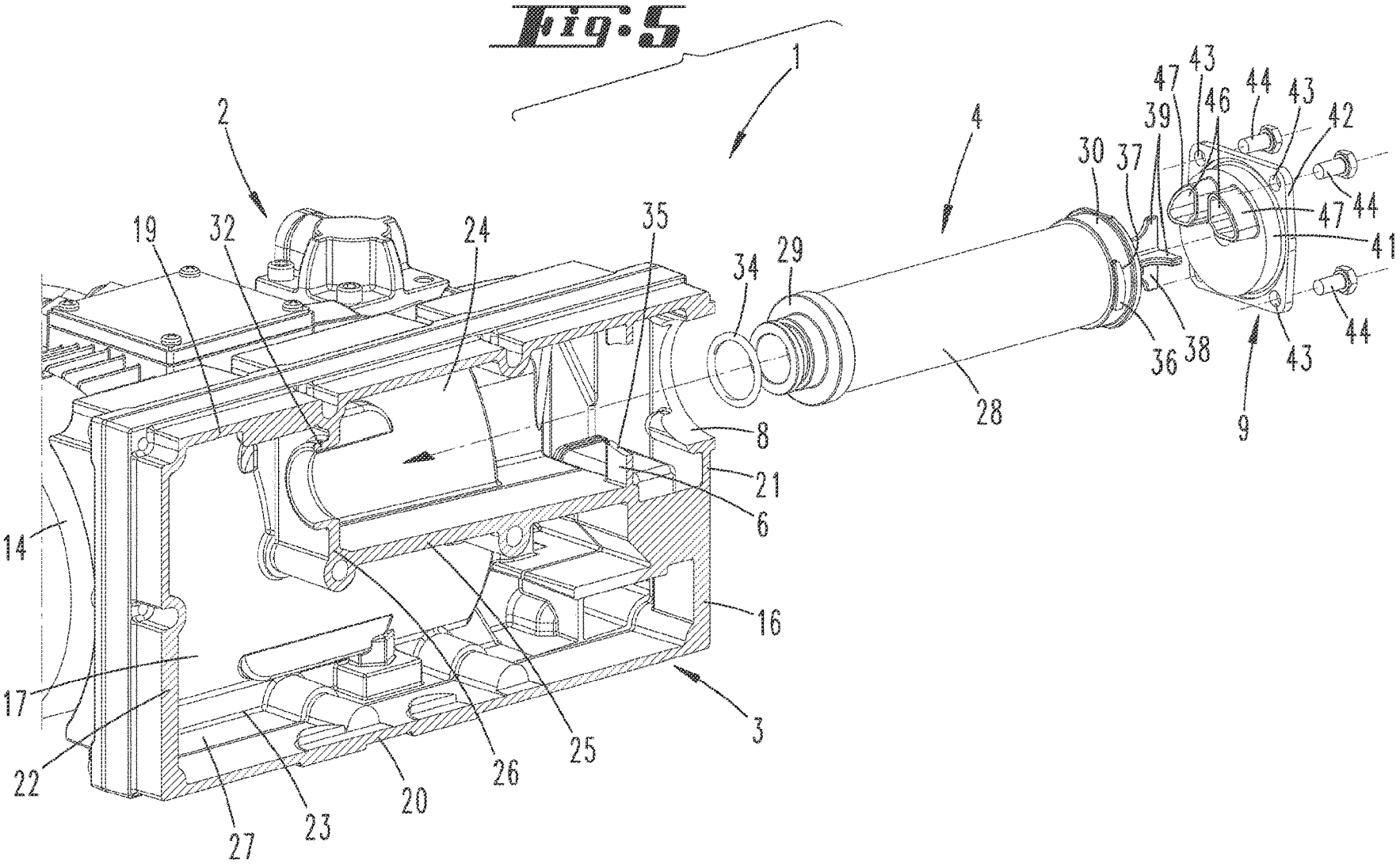
FIG. 5 shows a sectional perspective view substantially corresponding to FIG. 3 with an assignable air/oil separating element and an assignable cover.
Figure 6:
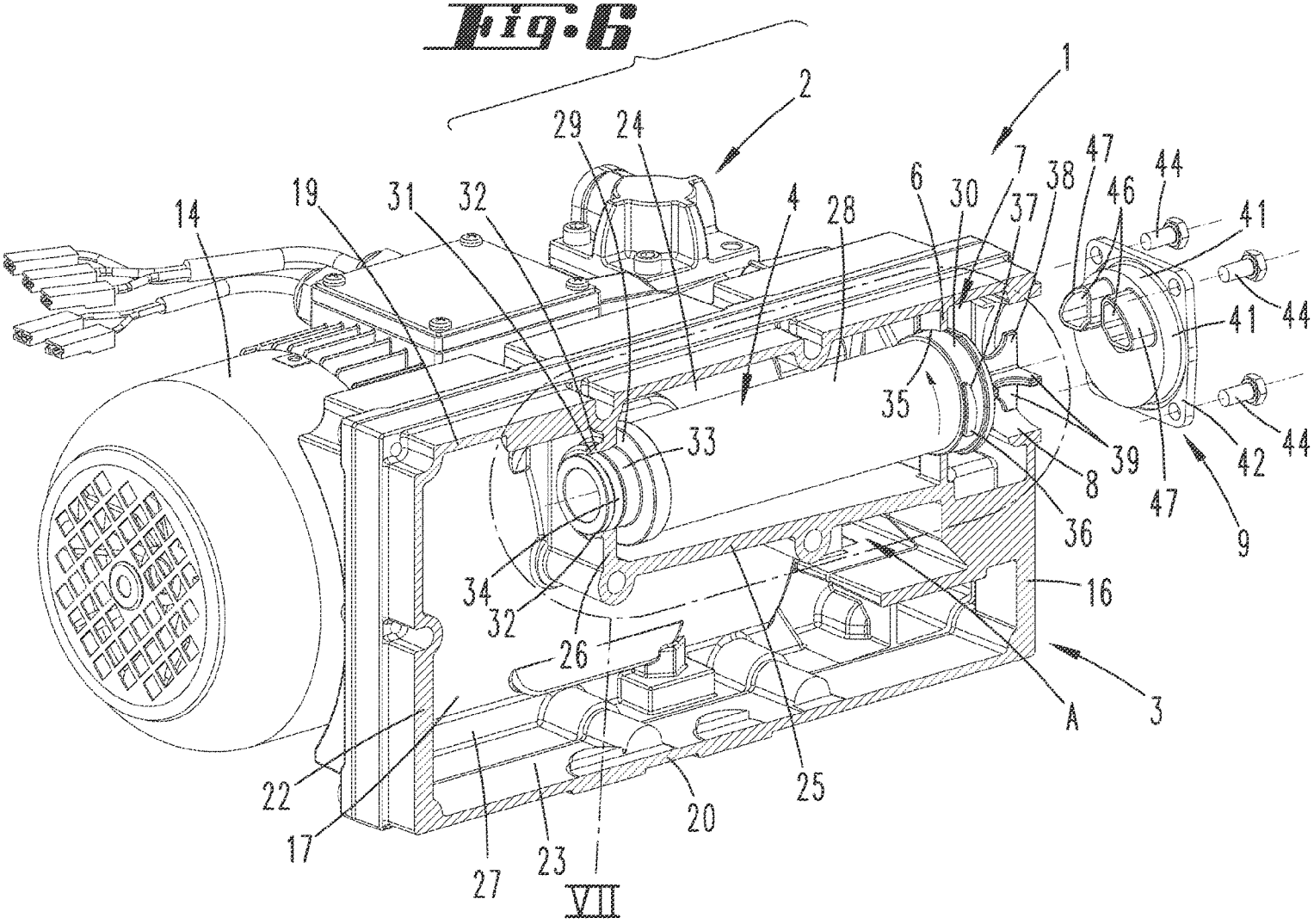
FIG. 6 shows an illustration substantially corresponding to FIG. 5, but after the plug-in arrangement of the air/oil separating element in the oil separator device.
Figure 7:
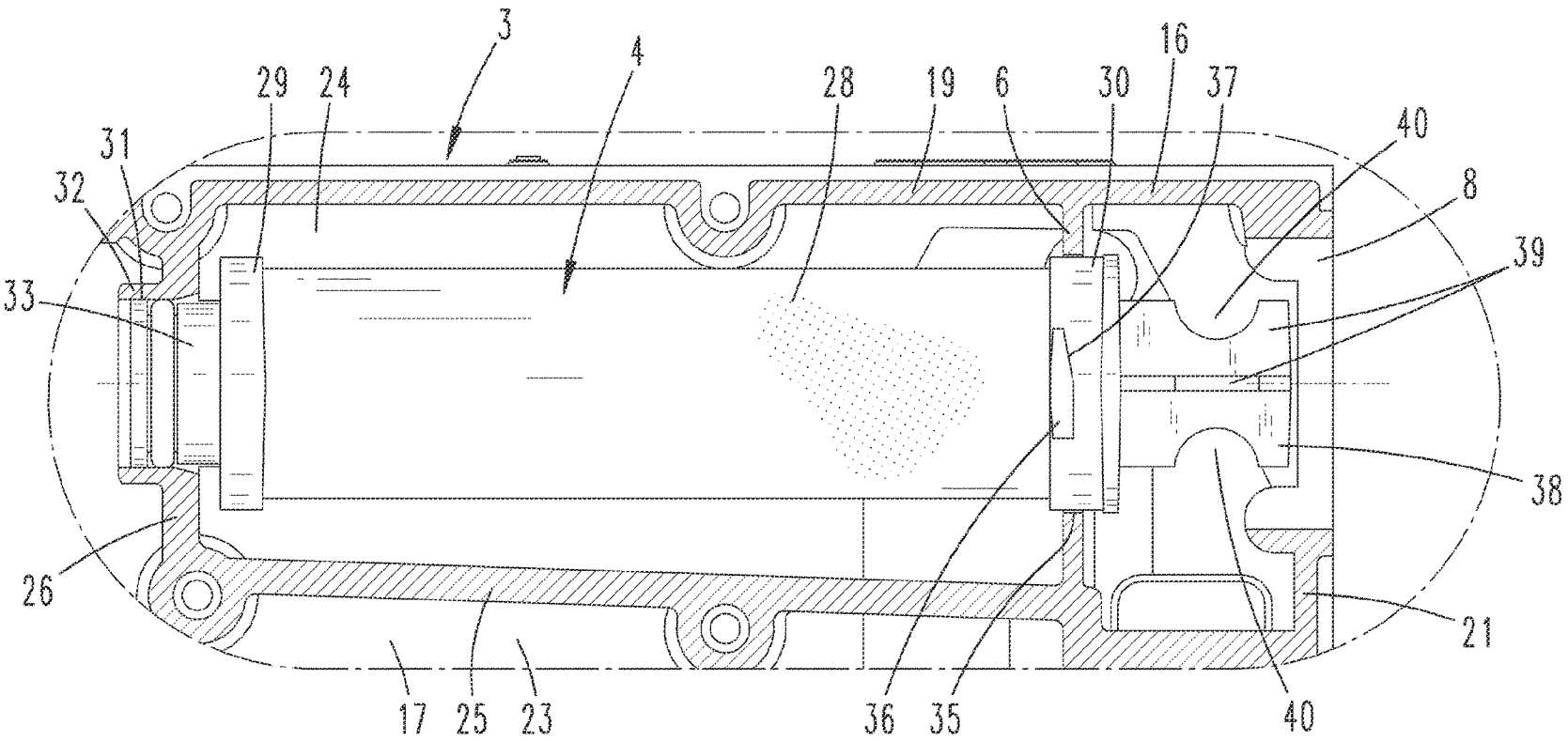
FIG. 7 shows the enlargement of the region VII in FIG. 6.

Here, the filter element 28 can comprise, as shown for example in the individual illustration according to FIG. 4, a tubular filter mat, the tube axis of which can be oriented in the same direction as the rotor axis of the rotary vane rotor 11. Thus, the filter element 28 and therefore the entire air/oil separating element 4 can be arranged oriented substantially in the longitudinal direction of the oil separator housing 16.

The oil/gas mixture deflected from the lower chamber 23 into the upper chamber 24 is specifically directed through the air/oil separating element 4, wherein a pressure difference can arise upstream and downstream of the air/oil separating element 4, which can be up to 400 mbar depending on the feed pressure of the rotary vane unit 2.

As can be seen, for example, from FIG. 2, there is a central axial flow to the air/oil separating element 4 or the filter element 28, wherein, by passing through the filter element 28 radially outwards, the purified gas can pass through an annular space remaining between the filter element 28 and the chamber wall of the upper chamber 24 and, by passing through or flowing around the mounting wall 6, can exit the oil separator housing 16 to reach the outside.

The oil droplets thereby separated in the filter element 28 are returned to the previously described oil sump.

The filter element 28 of the air/oil separating element 4 is in each case axially fitted at the end by a plug-in ring 29 in the region of the distal end and a flange part 30 in the region of the proximal end.

The plug-in ring 29 preferably serves here for sealingly plug-connecting the air/oil separating element 4 in the region of the rear mounting wall 26.

The rear mounting wall 26 has a central opening 31, which is enclosed by a collar 32. A reduced-diameter portion 33 of the plug-in ring 29 can be inserted into this opening 31, for which purpose the air/oil separating element 4, enclosed in the upper chamber 24, is preferably displaced in the longitudinal extent of the air/oil separating element 4 towards the opening 31.

This results in a seal between the portion 33 and the collar 32 of the opening 31, in particular due to the arrangement of, for example, a circumferential sealing ring 34 mounted on the portion 33. This sealing ring 34 which, for example, is designed as an O-ring, offers the possibility of a radial seal with possible axial displaceability.

In the region of the flange part 30, which is spaced apart from the plug-in ring 29 in the axial direction, the air/oil separating element 4 is supported and mounted in the region of the mounting wall 6. This mounting wall 6 is spaced apart substantially in the axial direction of the air/oil separating element 4 from the facing outer wall 21 towards the housing interior.

The flange part 30 is supported here in the region of an aperture 35 provided in the mounting wall 6.

For axially fixing the air/oil separating element 4, bayonet lugs 36 are formed on the outside of the wall, preferably diametrically opposite with respect to the element axis x, which in the course of a rotational displacement of the air/oil separating element 4 about the element axis x come into action with the mounting wall 6 via formed control bevels 37. In this manner, a bayonet mounting of the air/oil separating element 4 in the upper chamber 24 can be achieved, wherein in the course of reaching the bayonet mounting position according to FIG. 8, an axial displacement of the air/oil separating element 4, and thus also of the portion 33 with its sealing ring 34, into the sealing position is also achieved at the same time. In the bayonet mounting position, the air/oil separating element is axially secured between the mounting walls 6 and 26.

Figure 8:
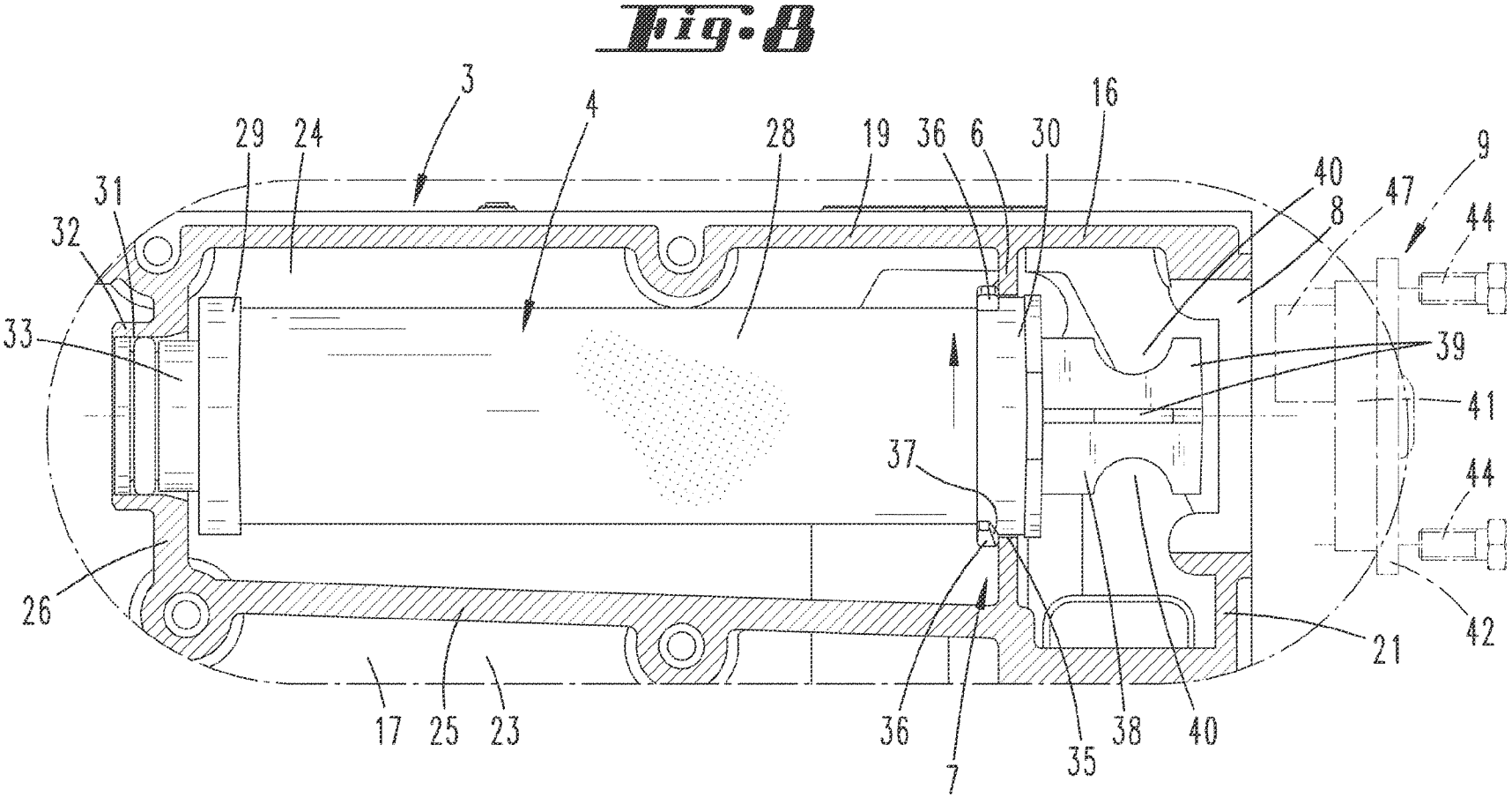
FIG. 8 shows a subsequent illustration to FIG. 7, after rotation of the air/oil separating element about a longitudinal axis for mounting the air/oil separating element in the oil separator device in a bayonet-like manner.
Figure 9:
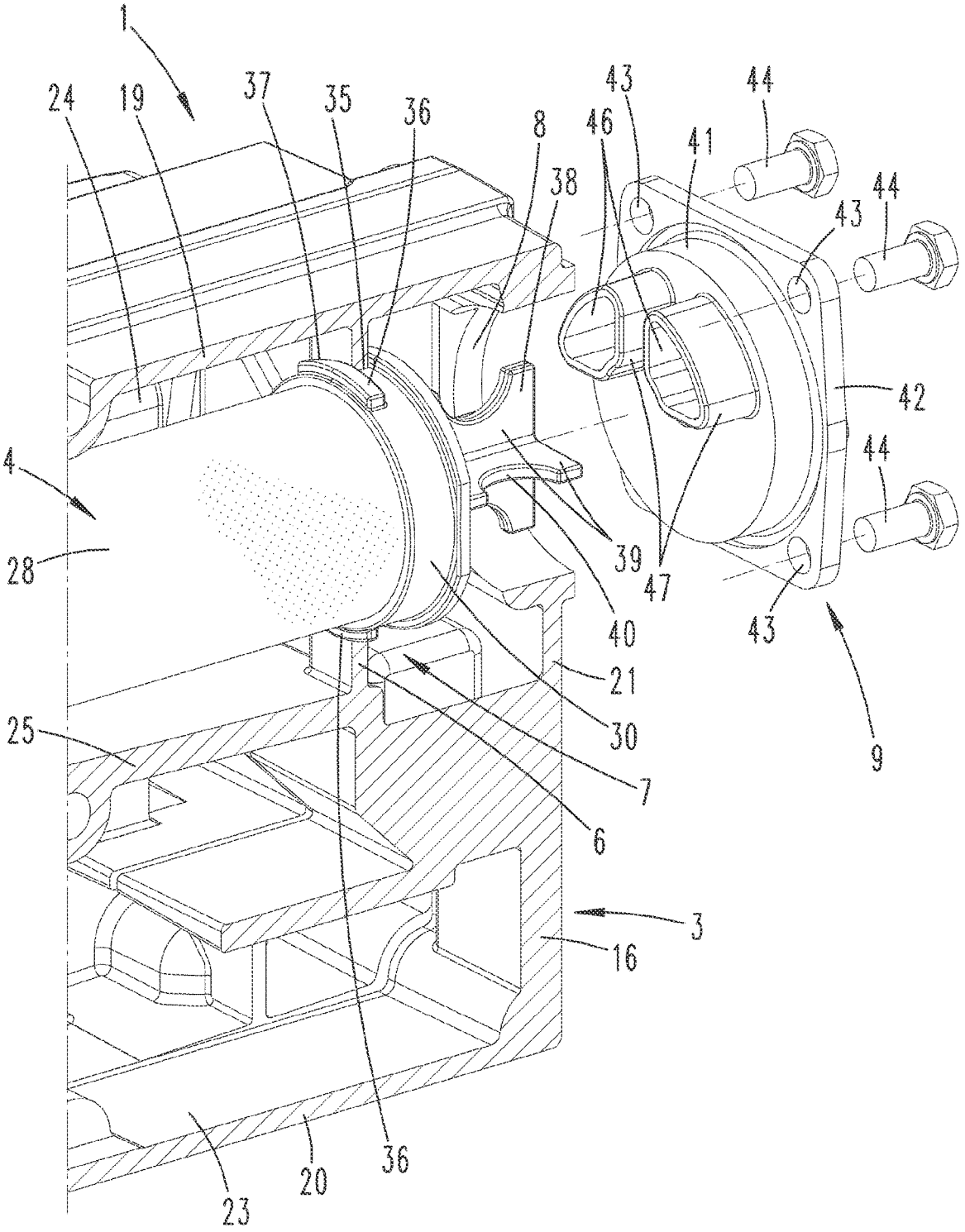
FIG. 9 shows a perspective sectional view of the situation according to FIG. 8, with the assignable cover.
Figure 10:
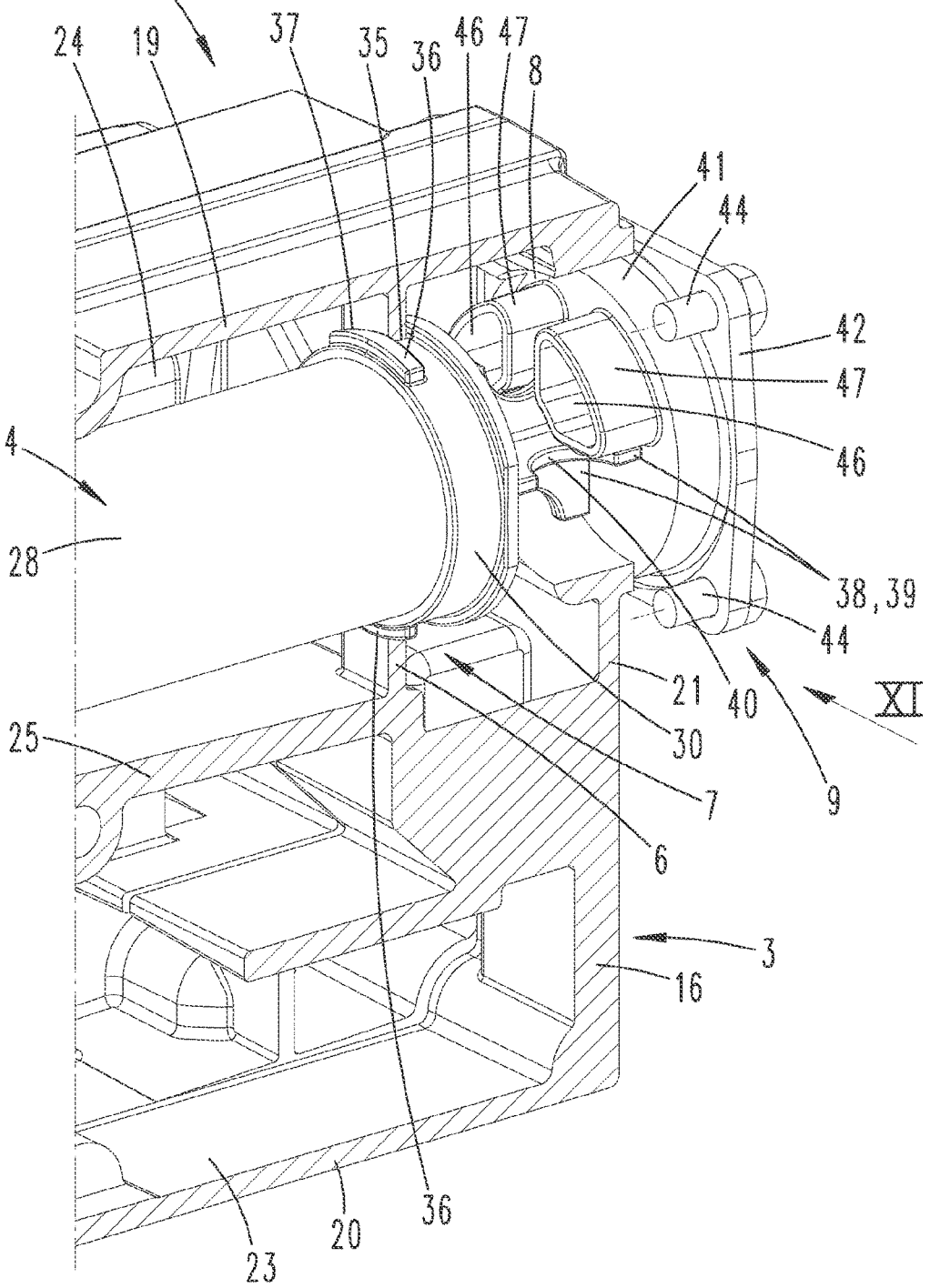
FIG. 10 shows a view corresponding to FIG. 9, but after assigning and fixing the cover for closing the mounting opening.

The rotational displacement of the air/oil separating element 4 to reach the mounting position as shown in FIG. 8 can be achieved using a handling extension 38 of the air/oil separating element 4. This handling extension 38 can be formed on the flange part 30 on the region thereof facing away from the filter element 38 and, in the usual position of use of the air/oil separating element 4, can thereby preferably extend substantially between the mounting wall 6 and the facing outer wall 21 within the oil separator housing 16.

The handling extension 38, as also shown, can consist of two plate parts 39 arranged in a cross-shaped manner with respect to each other. This results in a cross shape of the plate parts 39 with respect to a projection along the element axis x onto a transverse plane to the element axis x.

For the formation of the handling extension 38, the plate parts 39 can be formed integrally with and/or from the same material as the flange portion 30.

Each plate part 39 can have a gripping recess 40 that is open-edged radially outwards with respect to the element axis x.

The mounting opening 8 is formed, preferably concentric with the element axis x, in the facing outer wall 21 of the oil separator housing 16. Through this mounting opening 8, access to the handling extension 38 of the air/oil separating element 4 is enabled, namely in particular for inserting or removing the air/oil separating element 4 through the mounting opening 8.

The cover 9, which serves to close the mounting opening 8, in first instance has a closure nozzle 41 which, where appropriate, is adapted to the opening contour of the mounting opening 8. A fastening collar 42 can be molded thereon.

While the closure nozzle 41, viewed transversely to the element axis x, can have a circular plan view, the fastening collar 42 can span a surface area that is substantially square in plan view, such that in particular the corner regions of the fastening collar 42 project radially beyond the closure nozzle 41. In these corner regions, through holes 43 can be provided for the passage of screws 44. By means of these screws 44, a screw fastening of the cover 9 on the outside of the outer wall 21 is made possible, for which purpose the outer wall 21 can have corresponding threaded holes 45.

Furthermore, in the illustrated exemplary embodiment, the cover 9 is provided with two through openings 46 for discharging the purified gas. These through openings 46 can extend substantially in the direction of extent of the element axis x, wherein, furthermore, these through openings 46 can each have a wall extension 47 on the inside of the cover, i.e., facing away from the fastening collar 42 and facing the filter element 28 in the assignment position. These wall extensions 47 can form an axial extension of the wall comprising the through opening 46 also in the region of the closure nozzle 41.

The length of the wall extensions 47 as viewed in the axial direction, in particular the length of the wall extensions 47 projecting freely beyond the end face of the closure nozzle 41 facing the filter element 28, can further be selected such that, in the ready-to-operate receiving position of the air/oil separating element 4 and the closing position of the mounting opening 8, the wall extensions 47 can be provided in a projection transverse to the element axis x such that they overlap at least partially with the plate parts 29 or, respectively, the handling extension 38 of the air/oil separating element 4.

Figure 11:
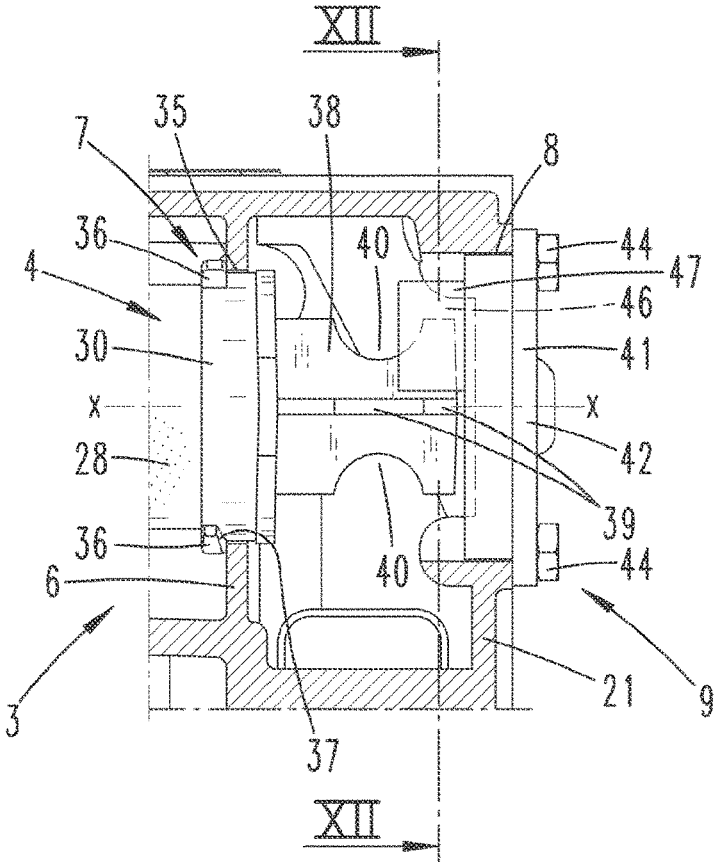
FIG. 11 shows the view according to arrow XI in FIG. 10.
Figure 12:
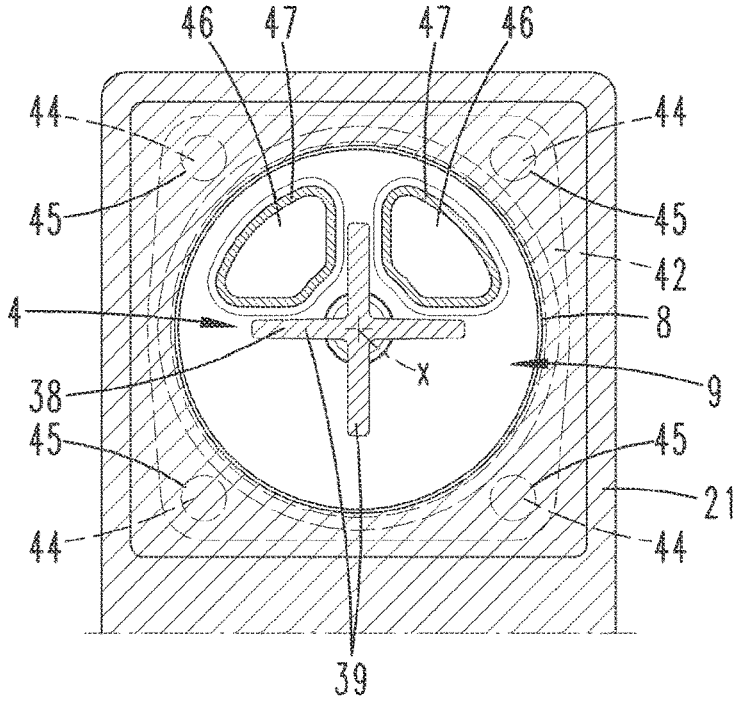
FIG. 12 shows the section according to line XII-XII in FIG. 11.

Here, the wall extensions 47 can each span such an area in plan view, and furthermore can be spaced apart from one another in the circumferential direction, that the wall extensions 47, in the mounting opening/closing position, engage between two plate parts 39 that follow one another in the circumferential direction (cf. FIGS. 11 and 12). This provides that the air/oil separating element 4 or the filter element 28 is secured against rotation by blocking engagement of at least one wall extension 47 in an intermediate space between two plate parts 29 following one another in the circumferential direction.

Preferably, correct closure of the mounting opening 8 by the cover 9 is only possible in the illustrated bayonet closing position of the air/oil separating element 4. If the bayonet mounting end position of the air/oil separating element 4 is not reached, the cover 9, according to a preferred configuration, cannot be correctly attached and screwed to the oil separator housing 16 or to the outer wall 21. In such a case, the wall extensions 47 interferingly abut against portions of the plate parts 39 so that the cover 9 cannot reach its correct engagement position on the outer wall 21.

The foregoing explanations serve to explain the inventions which are covered by the application as a whole and each of which, also independently, further refine the prior art at least by means of the following combinations of features, wherein two, more or all of these combinations of features can also be combined, namely:

A rotary vane vacuum pump 1, which is characterized in that a mounting wall 6 of the housing 16, extending at a distance from the outer wall 21 of the housing 16, is designed to interact with the moulding of the filter element 28 and to form the bayonet mounting, that a separate cover 9 is provided, which permits a mounting opening 8, associated with the filter element 23, in the outer wall 21 of the housing 16 to be closed, and that the cover 9 form-fittingly interacts with the filter element 28 to secure the filter element 28 against rotation.

A rotary vane vacuum pump 1, which is characterized in that the cover 9 is designed for plug-in mounting in the housing 16.

A rotary vane vacuum pump 1, which is characterized in that the cover 9 can be fixed to the housing 16 by means of screws 44.

A rotary vane vacuum pump 1, which is characterized in that the filter element 28, associated with the outer wall 21, has a handling extension 38 projecting from a flange part 30 of the filter element 28 towards the outer wall 21 of the housing 16.

A rotary vane vacuum pump 1, which is characterized in that the handling extension 38 is formed in a knob-like manner.

A rotary vane vacuum pump 1, which is characterized in that the handling extension 38 consists of one or more plate parts 39.

A rotary vane vacuum pump 1, which is characterized in that the handling extension 38 consists of two plate parts 39 arranged in a cross-shaped manner.

A rotary vane vacuum pump 1, which is characterized in that the cover 9 has one or more through openings 46 for discharging of purified gas.

A rotary vane vacuum pump 1, which is characterized in that a through opening 46 on the inside of the cover facing the filter element 28 has a wall extension 47 which can enter into a form-fitting connection with the handling extension 38 of the filter element 28.

All features disclosed are (in themselves) pertinent to the invention. The disclosure content of the associated/accompanying priority documents (copy of the prior application) is also hereby included in full in the disclosure, including for the purpose of incorporating features of these documents in the claims in the present application. The subsidiary claims, even without the features of a referenced claims, characterize with their features independent inventive refinements of the prior art, in particular to undertake divisional applications based on these claims. The invention specified in each claim may additionally have one or more of the features specified in the above description, in particular those with reference numerals and/or specified in the reference list. The invention further relates to forms of design in which individual features mentioned in the above description are not implemented, in particular insofar as they are evidently dispensable for the respective intended use or can be replaced by other means having the same technical effect.

REFERENCE LIST

1 rotary vane vacuum pump
2 rotary vane unit
3 oil separator device
4 air/oil separating element
5 ------
6 mounting wall
7 bayonet mounting
8 mounting opening
9 cover
10 rotary vane chamber
11 rotary vane rotor
12 vane
13 slot
14 electric motor
15 chamber
16 oil separator housing
17 side wall
18 top wall
20 bottom wall
21 outer wall
22 outer wall
23 lower chamber
24 upper chamber
25 separating bottom
26 mounting wall
27 housing portion
28 filter element
29 plug-in ring
30 flange part
31 opening
32 collar
33 portion
34 sealing ring
35 aperture
36 bayonet lug
37 control bevel
38 handling extension
39 plate part
40 gripping recess
41 closure nozzle
42 fastening collar
43 through hole
44 screw
45 threaded hole
46 through opening
47 wall extension
s flow
x element axis
A outlet side
E inlet side

The invention claimed is:

1. An oil-lubricated rotary vane vacuum pump comprising:

a rotary vane unit having a rotary vane chamber and a rotary vane rotor, an oil separator device having a housing and being configured for separating gas and oil, by an air/oil separating element, wherein the air/oil separating element has a filter element which has a plug-in ring at an end that can be is plug-connected on a housing side to the rotary vane unit, which plug-in ring is designed for radial sealing and axial displaceability in an associated housing receptacle, and the filter element has a moulding for bayonet mounting, which moulding faces an end associated with an outer wall of the housing, wherein a mounting wall of the housing, extending at a distance from the outer wall of the housing, is designed to interact with the moulding of the filter element and to form the bayonet mounting, wherein a separate cover is provided, which permits a mounting opening, associated with the filter element, in the outer wall of the housing to be closed, and wherein the cover form-fittingly interacts with the filter element to secure the filter element against rotation.

2. The rotary vane vacuum pump according to claim 1, wherein the cover is designed for plug-in mounting in the housing.

3. The rotary vane vacuum pump according to claim 1, wherein the cover is fixed to the housing by means of screws.

4. The rotary vane vacuum pump according to claim 1, wherein the filter element, associated with the outer wall, has a handling extension projecting from a flange part of the filter element towards the outer wall of the housing.

5. The rotary vane vacuum pump according to claim 4, wherein the handling extension is formed in a knob-like manner.

6. The rotary vane vacuum pump according to claim 1, wherein the handling extension consists of one or more plate parts.

7. The rotary vane vacuum pump according to claim 4, wherein the cover has at least one through opening for discharging purified gas, and wherein the at least one through opening, on an inside of the cover facing the filter element, has a wall extension which is configured to enter into a form-fitting connection with the handling extension of the filter element.

8. The rotary vane vacuum pump according to claim 6, wherein the handling extension consists of two plate parts arranged in a cross-shaped manner.

9. The rotary vane vacuum pump according to claim 1, wherein the cover has one or more through openings for discharging purified gas.

* * * * *